US009359753B2

(12) United States Patent
Hirakawa et al.

(10) Patent No.: US 9,359,753 B2
(45) Date of Patent: Jun. 7, 2016

(54) FLUSH TOILET

(71) Applicant: TOTO LTD., Kitakyushu-shi, Fukuoka (JP)

(72) Inventors: Tomohiro Hirakawa, Kitakyushu (JP); Masaki Kitamura, Kitakyushu (JP); Shu Kashirajima, Kitakyushu (JP); Yuki Shinohara, Kitakyushu (JP); Koji Kamei, Kitakyushu (JP)

(73) Assignee: TOTO LTD., Kitakyushu-Shi, Fukuoka (JP)

( * ) Notice: Subject to any disclaimer, the term of this patent is extended or adjusted under 35 U.S.C. 154(b) by 249 days.

(21) Appl. No.: 14/226,431

(22) Filed: Mar. 26, 2014

(65) Prior Publication Data

US 2014/0289947 A1 Oct. 2, 2014

(30) Foreign Application Priority Data

Mar. 29, 2013 (JP) ..... 2013-071462
Sep. 26, 2013 (JP) ..... 2013-200276

(51) Int. Cl.
*E03D 11/02* (2006.01)
*E03D 11/08* (2006.01)

(52) U.S. Cl.
CPC ..... *E03D 11/08* (2013.01); *E03D 2201/40* (2013.01)

(58) Field of Classification Search
CPC ..... E03D 11/02
USPC ..... 4/421
See application file for complete search history.

(56) References Cited

U.S. PATENT DOCUMENTS 7,661,153 B2 * 2/2010 Nakamura ..... E03D 11/08 4/420
7,827,628 B2 * 11/2010 Ichiki ..... E03D 11/08 4/420
2013/0019391 A1 * 1/2013 Yoneda ..... E03D 11/08 4/421
2013/0219605 A1 * 8/2013 Grover ..... E03D 11/08 4/300.3

* cited by examiner

*Primary Examiner* — Huyen Le
(74) *Attorney, Agent, or Firm* — Brooks Kushman P.C.

(57) ABSTRACT

A flush toilet which including a bowl portion having a waste-receiving surface, a rim and a recess; a water spouting portion for spouting the flush water forwardly; and a drainage conduit. The recess of the bowl portion has a bottom below a pooled water level, and a wall surface connecting between the bottom and a lower edge of the waste-receiving surface, wherein the bottom of the recess has a front bottom surface and a rear bottom surface. The bowl portion is configured to allow flush water to form a major stream which is directed to flow from an front end of the bowl portion toward the inlet of the drainage conduit, and the rear bottom surface of the bottom is configured to allow a part of the major stream to collide therewith, and then guide the collided major stream to a front region inside the drainage conduit.

14 Claims, 9 Drawing Sheets

(a)

(b)

FLUSH TOILET

CROSS-REFERENCE TO RELATED APPLICATIONS

This application claims priority to JP application JP 2013-071462 filed on Mar. 29, 2013, and JP application JP 2013-200276 filed Sep. 26, 2013 the disclosures of which are incorporated in their entirety by reference herein.

TECHNICAL FIELD

The present invention relates to a flush toilet, and more particularly to a flush toilet capable of reliably discharging small pieces of waste and floating pieces of waste.

BACKGROUND

There has heretofore been known a flush toilet which is configured to discharge waste by allowing flush water spouted from a rim spout port (first outlet port) to swirlingly flow along a rim water flow passage and form a major stream which is directed to flow rearwardly from a front end of a bowl surface into an inlet of a drainage conduit (trap), as described in, for example, JP 2011-157738A (Patent Document 1) and JP 2011-174363A (Patent Document 2). In this flush toilet, with a view to facilitating flush water to flow into the inlet of the drainage conduit, the drainage conduit comprises an introduction conduit portion which has an opening oriented upwardly and extends rearwardly and obliquely downwardly.

There has also been known a flush toilet which is configured to discharge waste by promoting a swirl flow of pooled water in such a manner that a bowl surface is formed with a recess having a bottom formed at a position below a level of the pooled water and around an entire circumference of an inlet of a drainage conduit, as described in JP 07-310352A (Patent Document 3).

SUMMARY

Technical Problem

However, in the flush toilets described in the Patent Documents 1 and 2, the major stream spouted from the rim spout port and directed to flow rearwardly from the front end of the bowl surface swiftly flows into the introduction conduit portion, so that flush water in a rear region of the introduction conduit portion has a relatively high velocity, whereas flush water flowing into a front region of the introduction conduit portion has a relatively low velocity, so that stagnation occurs in the front region, which hinders a smooth flow in the drainage conduit. The situation where the flow in the drainage conduit is disrupted as mentioned above, i.e., there is a deviation in velocity distribution between the front region and the rear region (velocity distribution is not uniform), gives rise to a problem that small pieces of waste and floating pieces of waste are kept staying in pooled water without being discharged.

As means to solve the problem of the stay of small pieces of waste and floating pieces of waste, it is conceivable to allow small pieces of waste and the like to gather at a center of the pooled water by improving swirling strength of pooling water. In this case, however, it is unable to effectively solve the above problem, because the small pieces of waste and the like are simply swirled together with the pooled water, without being moved into drainage conduit.

Therefore, the present invention has been made to solve the conventional defects, and an object thereof is to provide a flush toilet capable of allowing a flow in a drainage conduit to become smooth, thereby reliably discharging small pieces of waste and floating pieces of wastes, together with heavy pieces of waste.

Solution to the Technical Problem

In order to achieve the above object, the present invention provides a flush toilet for flushing a toilet main unit with flush water supplied from a flush water source, to discharge waste. The flush toilet comprises: a bowl portion having a waste-receiving surface, a rim located along an upper edge thereof, and a recess formed below the waste-receiving surface; a water spouting portion for spouting the flush water toward a front end of the bowl portion so as to form a swirl flow which swirlingly flows along an inner peripheral surface of the rim; and a drainage conduit having an inlet connecting with the recess of the bowl portion so as to discharge waste therethrough. The recess of the bowl portion has a bottom located below a pooled water level, and a wall surface connecting between the bottom and a lower edge of the waste-receiving surface. The bottom of the recess has a front bottom surface formed in a front region of the recess, and a rear bottom surface formed in a rear region of the recess. The bowl portion is configured to allow flush water spouted from the water spouting portion to form a major stream which is directed to flow from the front end of the bowl portion toward the inlet of the drainage conduit, and the rear bottom surface of the bottom of the recess is configured to allow a part of the major stream to collide therewith, and then guide the collided major stream to a front region inside the drainage conduit.

In the above flush toilet of the present invention, flush water spouted forwardly from the water spouting portion forms a major stream which is directed to flow from the front end of the bowl portion toward the inlet of the drainage conduit. Then, a part of the major stream is brought into collision with the rear bottom surface of the bottom of the recess, and the collided major stream is guided to flow toward the front region inside the drainage conduit. Therefore, no stagnation occurs in the front region of the drainage duct, and, in a rear region of the drainage duct into which flush water directly flows from the front end of the bowl portion, and the front region of the drainage duct into which flush water flows after colliding with the rear bottom surface of the bottom, a flow velocity distribution of flush water is uniformed (velocity distribution of flush water is equalized), and thereby a flow of flush water in the drainage conduit becomes smooth, so that it becomes possible to reliably discharge small pieces of waste and floating pieces of waste, without staying of the waste in the front region of the drainage conduit.

Preferably, in the flush toilet of the present invention, the drainage conduit comprises: an introduction conduit portion connecting with the bottom of the recess, with an inner diameter approximately equal to that of the bottom, and extending rearwardly and obliquely downwardly; and a drainage trap conduit portion connecting with the introduction conduit portion and extending upwardly.

In this feature, the introduction conduit portion is provided in such a manner that it connects with the bottom of the recess, with an inner diameter approximately equal to that of the bottom, and extends rearwardly and obliquely downwardly, so that it becomes possible to smoothly introduce flush water into the introduction conduit portion, and therefore reliably discharge small pieces of waste and floating pieces of waste.

Preferably, in the flush toilet of the present invention, the rear bottom surface of the recess is formed to incline inwardly and obliquely downwardly.

In this feature, the rear bottom surface of the recess inclines inwardly and obliquely downwardly, so that it becomes possible to smoothly guide the partial major stream after colliding with the rear bottom surface, toward the front region of the drainage duct. Therefore, flow velocities in the front and rear regions of the drainage duct are uniformed, so that it becomes possible to reliably discharge small pieces of waste and floating pieces of waste.

More preferably, the front bottom surface of the recess is formed to extend approximately horizontally.

According to this feature, a part of flush water spouted from the water spouting portion and guided to swirlingly flow intrudes into the recess from a position rearward of the recess, and collides with the front bottom surface formed to extend approximately horizontally, and then the collided flush water is moved upwardly, and mixed with the major stream flowing thereabove. Therefore, waste is effectively agitated and smoothly introduced into the drainage duct.

More preferably, the front bottom surface of the recess is formed to be located above a lower end of the rear bottom surface.

According to this feature, the flush water moved upwardly due to the collision with the front bottom surface flows rearwardly, and collides with the rear bottom surface, so that it is guided to the front region of the drainage duct. Therefore, flow velocities in the front and rear regions of the drainage duct are uniformed, so that it becomes possible to reliably discharge small pieces of waste and floating pieces of waste, without staying of the waste in the front region of the drainage conduit.

More preferably, the recess is formed such that a wall surface in each of right and left lateral regions thereof becomes flush with an internal lateral surface of the drainage conduit, in an upward-downward direction.

In this feature, the wall surface in each of the right and left lateral regions of the recess is formed to become flush with the internal lateral surface of the drainage conduit, in an upward-downward direction, i.e., the bottom is not formed in the right and left lateral regions of the recess, so that it becomes possible to destroy a swirl flow of flush water which would otherwise be formed on the bottom, by the right and left wall surface regions of the recess, and guide flush water to the front region of the discharge duct. As a result, flow velocities in the front and rear regions of the drainage duct are uniformed, so that it becomes possible to reliably discharge small pieces of waste and floating pieces of waste, without staying of the waste in the front region of the drainage conduit.

Preferably, in the flush toilet of the present invention, the inlet of the drainage conduit is formed in a shape in which a maximum width thereof in a lateral direction is greater than a maximum width thereof in a longitudinal direction, in top plan view.

In this feature, the inlet of the drainage conduit is formed in a shape in which a maximum width thereof in a lateral direction is greater than a maximum width thereof in a longitudinal direction, in top plan view, so that the relatively small longitudinal width of the inlet makes it possible to more easily guide flush water toward the front region of the drainage duct, and the relatively large lateral width of the inlet makes it possible to guide larger waste to the drainage duct.

More preferably, the drainage conduit is formed such that, in top plan view, the inlet thereof has a longitudinal center located rearward of a longitudinal center of a pooled water surface, and an area equal to or less than one-half of an area of the pooled water surface.

In this feature, the inlet of the drainage conduit is located offset rearwardly with respect to the pooled water surface, so that it becomes possible to more easily guide flush water to the front region of the drainage duct. Further, the inlet of the drainage conduit is formed to have an area less than that of the pooled water surface, so that flush water inflowing from a position rearward of the recess collides with the bottom, and the collided flush water flows rearwardly and, after colliding with the rear bottom surface, flows into the front surface of the drainage duct. Thus, a flow of flush water in the drainage duct becomes smooth, so that it becomes possible to reliably discharge small pieces of waste and floating pieces of waste without staying of the waste in the front region of the drainage conduit.

Preferably, in the flush toilet of the present invention, the waste-receiving surface of the bowl portion is formed in an upwardly convex shape over an entire region thereof.

In this feature, the waste-receiving surface of the bowl portion is formed in an upwardly convex shape over the entire region thereof, so that flush water flowing on the waste-receiving surface can be smoothly guided to gather at the inlet of the drainage duct, and therefore the flow of flush water in the drainage duct becomes smooth, so that it becomes possible to reliably discharge small pieces of waste and floating pieces of waste without staying of the waste in the front region of the drainage conduit.

Preferably, in the flush toilet of the present invention, the bowl portion is formed with a water guide channel for allowing flush water spouted from the water spouting portion to swirlingly flow along the inner peripheral surface of the rim, wherein the water guide channel is formed to extend from the water spouting portion toward the front end of the bowl portion while gradually inclining downwardly and then extend rearwardly from the front end while gradually inclining upwardly.

In this feature, the bowl portion is formed with a water guide channel for allowing flush water to swirlingly flow along the inner peripheral surface of the rim, wherein the water guide channel is formed to extend from the water spouting portion toward the front end of the bowl portion while gradually inclining downwardly and then extend rearwardly from the front end while gradually inclining upwardly, so that it becomes possible to form a large flow rate of major stream. A part of the major stream collides with the rear bottom surface of the bottom of the recess, and the collided major stream flows toward the front region inside the drainage duct. Therefore, flow velocities in the front and rear regions of the drainage duct are uniformed, so that it becomes possible to reliably discharge small pieces of waste and floating pieces of waste, without staying of the waste in the front region of the drainage conduit.

Preferably, in the flush toilet of the present invention, the drainage conduit comprises: an introduction conduit portion connecting with the bottom of the recess and extending rearwardly and obliquely downwardly; a rising conduit portion connecting with the introduction conduit portion and extending upwardly; and a lowering conduit portion connecting with the rising conduit portion and extending downwardly, wherein, on an assumption that, in a cross-section of the introduction conduit portion perpendicular to a central axis thereof, a region located below a line extending horizontally while intersecting the central axis is a lower region, and a region located above the line is an upper region, the introduction conduit portion is formed such that a cross-sectional area of the lower region is less than a cross-sectional area of the upper region, over an entire region ranging from an inlet thereof connecting with the bottom of the recess to an outlet thereof connecting with the rising conduit portion.

In this feature, on the assumption that, in a cross-section of the introduction conduit portion of the drainage duct perpendicular to a central axis thereof, a region located below a line extending horizontally while intersecting the central axis is a lower region, and a region located above the line is an upper region, the introduction conduit portion is formed such that a cross-sectional area of the lower region is less than a cross-sectional area of the upper region, over the entire region ranging from the inlet thereof connecting with the bottom of the recess to the outlet thereof connecting with the rising conduit portion, so that it becomes possible to increase a flow velocity in the lower region of the introduction conduit portion which would otherwise have a relatively low flow velocity, highly possibly causing staying of small pieces of waste and floating pieces of waste. Thus, in the upper region of the drainage duct into which flush water directly flows from the front end of the bowl portion, and the lower region of the drainage duct, a flow velocity distribution of flush water is uniformed (velocity distribution of flush water is equalized), and thereby a flow of flush water in the drainage conduit becomes smooth, so that it becomes possible to reliably discharge small pieces of waste and floating pieces of waste, without staying of the waste in the front region of the drainage conduit.

More preferably, the introduction conduit portion is formed such that a bottom of the cross-section thereof perpendicular to the central axis has a generally U shape.

In this feature, the bottom of the introduction conduit portion is formed in a generally U shape, so that it becomes possible to guide floating pieces of waste in the introduction conduit portion to gather in an approximately central region of the cross-section of the introduction conduit portion perpendicular to the central axis, and forming a smooth flow in which the flow velocity distribution of flush water is uniformed in the introduction conduit portion, thereby reliably discharging small pieces of waste and floating pieces of waste, without staying of the waste in the lower region of the drainage conduit.

More preferably, the rising conduit portion of the drainage conduit is formed such that a cross-sectional area thereof is greater than a smallest cross-sectional area of the introduction conduit portion.

In this feature, the rising conduit portion of the drainage conduit is formed such that a cross-sectional area thereof is greater than a smallest cross-sectional area of the introduction conduit portion, so that flush water passing through the introduction conduit portion is smoothly discharged along the rising conduit portion. Thus, it becomes possible to reliably discharge small pieces of waste and floating pieces of waste, without staying of the waste in the lower region of the drainage conduit.

More preferably, the drainage duct is formed such that, when a boundary point between the rising conduit portion and the lowering conduit portion is assumed to be a top of an internal upper surface of the rising conduit portion, a space for preventing occurrence of a siphon action is defined in a region above a position around the top.

According to this feature, when flush water flowing from the introduction conduit portion into the rising conduit portion and moving upwardly along the rising conduit portion flows into the lowering conduit portion after passing through a position around the top, the occurrence of a siphon phenomenon can be suppressed by the space defined in a region above a position around the top. Thus, it becomes possible to allow flush water passing through the rising conduct portion to be reliably discharged to the lowering conduct portion, beyond the top, and reliably discharge small pieces of waste and floating pieces of waste, without staying of the waste in the lower region of the drainage conduit.

DETAILED DESCRIPTION

Figure 1:
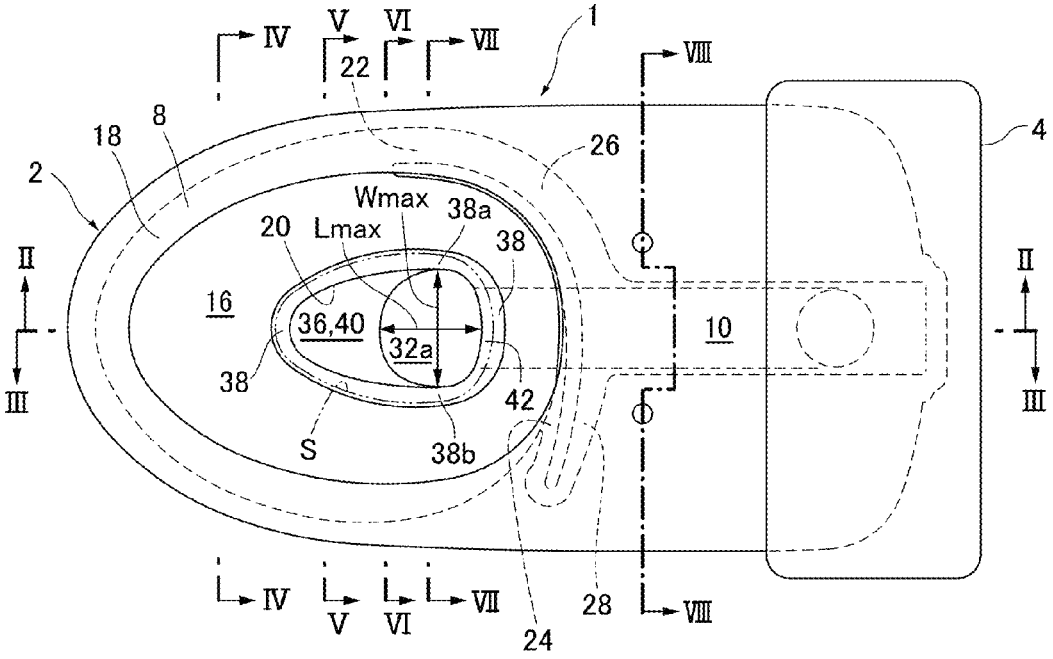
FIG. 1 is a top plan view illustrating a flush toilet according to one embodiment of the present invention.
Figure 2:
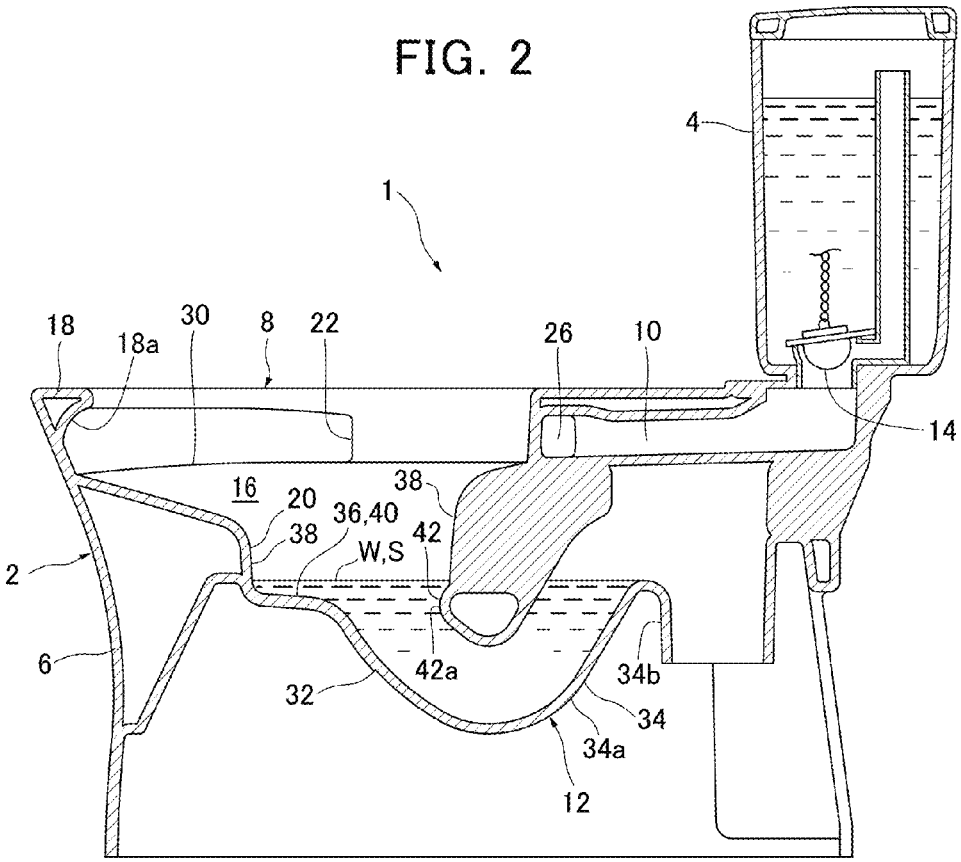
FIG. 2 is a sectional view taken along the line II-II in FIG. 1.
Figure 3:
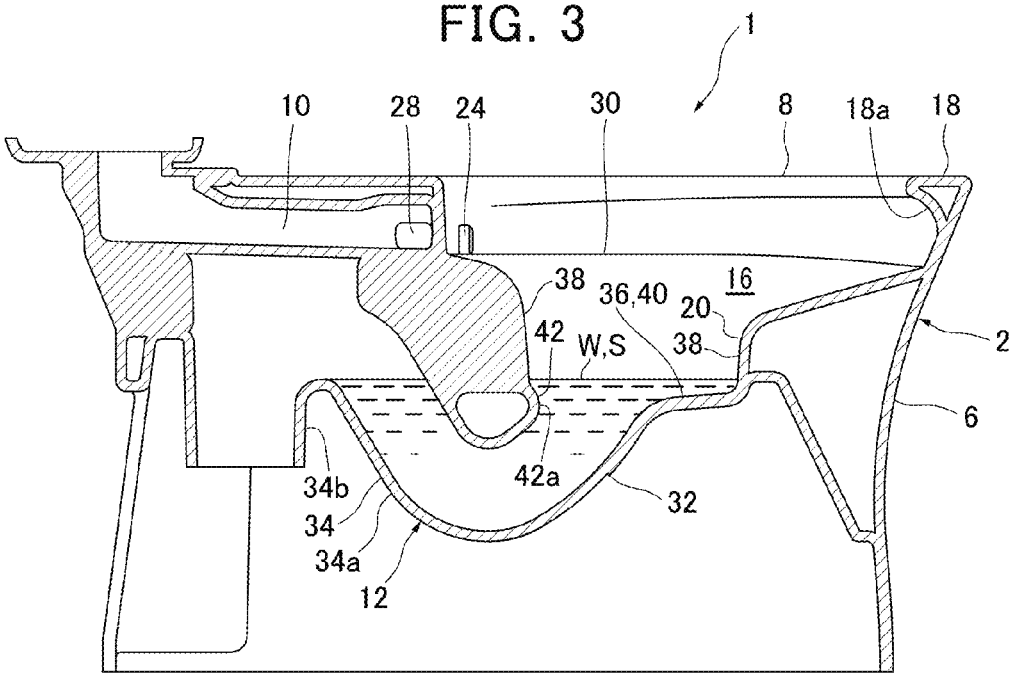
FIG. 3 is a sectional view taken along the line III-III in FIG. 1.
Figure 4:
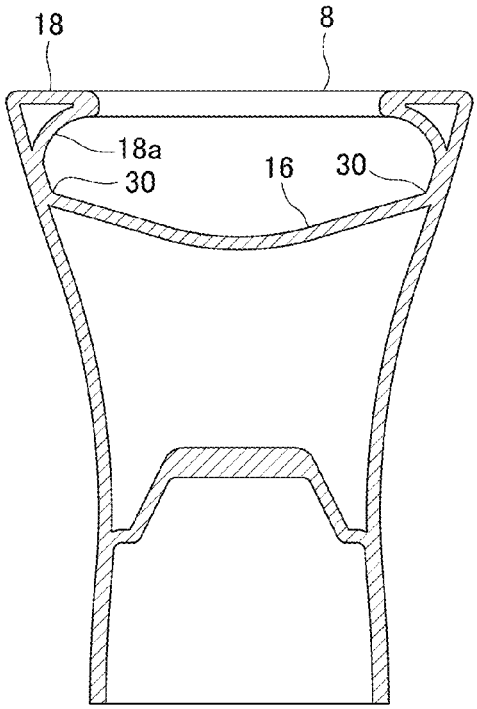
FIG. 4 is a sectional view taken along the line IV-IV in FIG. 1.
Figure 5:
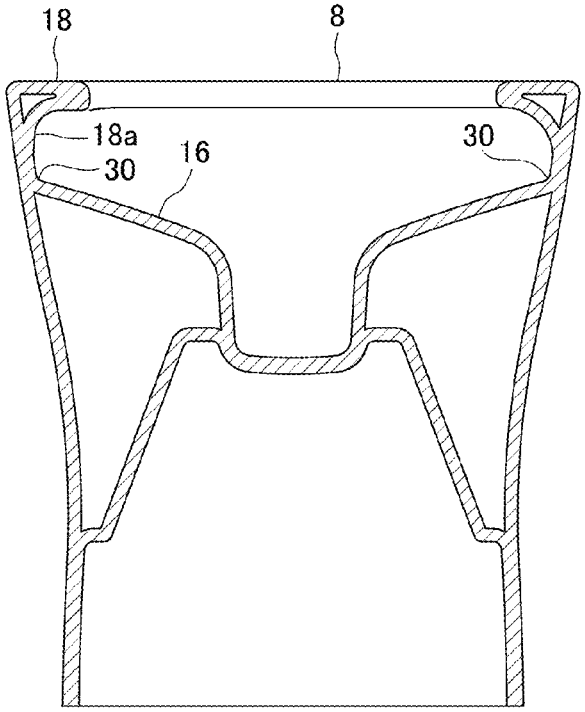
FIG. 5 is a sectional view taken along the line V-V in FIG. 1.
Figure 6:
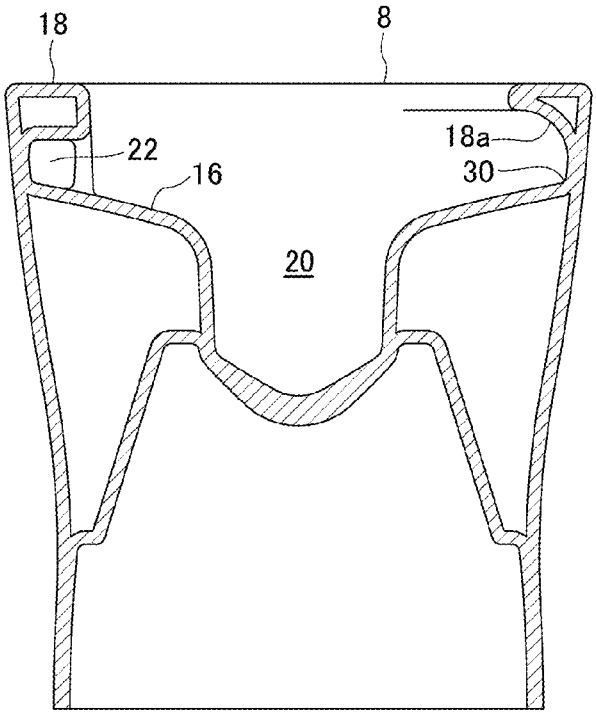
FIG. 6 is a sectional view taken along the line VI-VI in FIG. 1.
Figure 7:
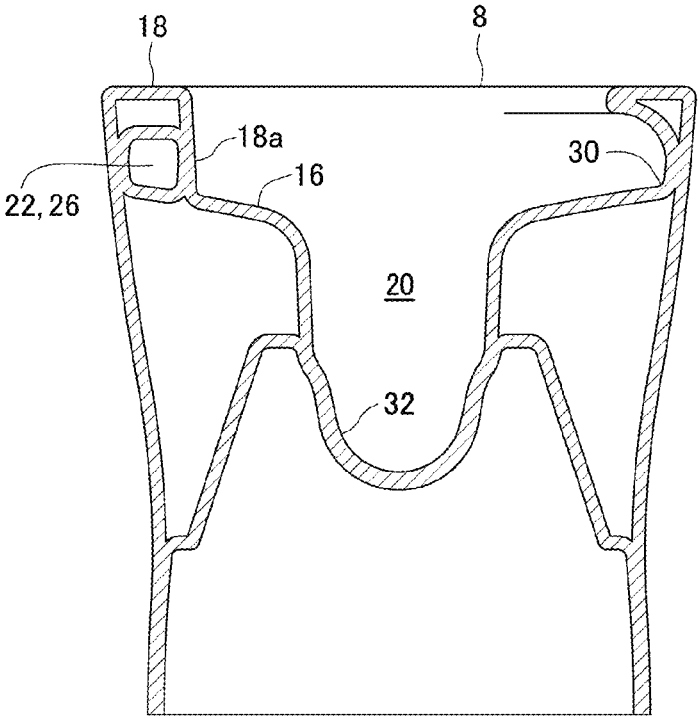
FIG. 7 is a sectional view taken along the line VII-VII in FIG. 1.
Figure 8:
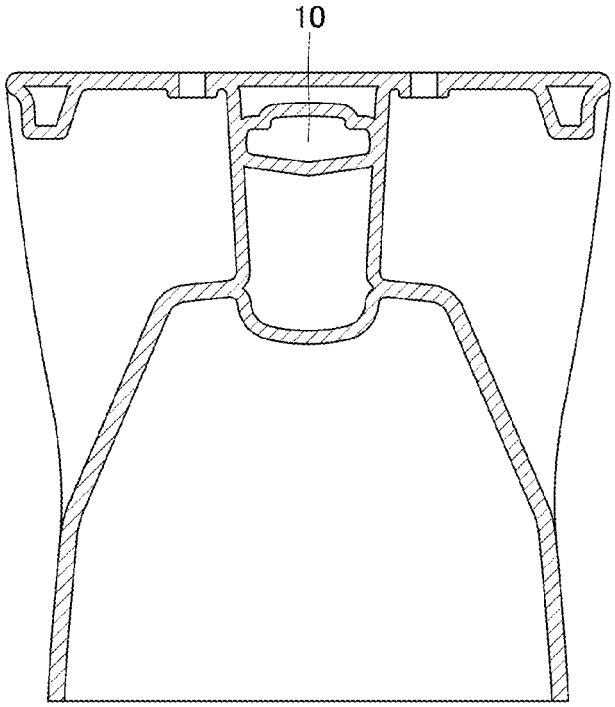
FIG. 8 is a sectional view taken along the line VIII-VIII in FIG. 1.

With reference to FIGS. 1 to 8, a flush toilet according to one embodiment of the present invention will now be described. FIG. 1 is a top plan view illustrating the flush toilet according to this embodiment, and FIG. 2 and FIG. 3 are, respectively, a sectional view taken along the line II-II in FIG. 1 and a sectional view taken along the line III-III in FIG. 1.

The flush toilet 1 according to this embodiment is a wash-down toilet of a floor drain type in which an aftermentioned drainage trap conduit portion is connected to a drain pipe (not illustrated) installed on the side of a floor. FIG. 4, FIG. 5, FIG. 6, FIG. 7 and FIG. 8 are, respectively, a sectional view taken along the line IV-IV in FIG. 1, a sectional view taken along the line V-V in FIG. 1, a sectional view taken along the line VI-VI in FIG. 1, a sectional view taken along the line VII-VII in FIG. 1 and a sectional view taken along the line VIII-VIII in FIG. 1.

As illustrated in FIGS. 1 and 3, the flush toilet 1 is a wash-down toilet configured to wash down waste by an action of flowing water arising from a water head difference within a bowl portion, wherein it comprises a toilet main unit 2, and a reservoir tank 4 which stores therein flush water for flushing the toilet main unit 2. The toilet main unit 2 is a porcelain product having a glaze layer formed on a surface thereof, wherein it has a lower section formed as a skirt 6, and an upper section having a front half formed as a bowl portion 8, and a rear half in which an upper area thereof is formed with a common water flow passage 10 having an upstream end communicating with the reservoir tank 4, and a lower area thereof is formed with a drainage conduit 12 for discharging waste therethrough.

The aforementioned reservoir tank 4 is a flush water source. The reservoir tank 4 is provided with a discharge valve 14 configured to be opened and closed by a manual operation lever (not illustrated). It is to be understood that the present invention can also be applied to a direct-pressure flush toilet of a type in which flush water is directly supplied from a city water line without providing a reservoir rank, a flush toilet of a type in which flush water is supplied via a flush valve, and others.

The bowl portion 8 has a bowl-shaped waste-receiving surface 16, a rim 18 located along an upper edge thereof, and a recess 20 formed below the bowl-shaped waste-receiving surface 16. In this embodiment, as illustrated in FIGS. 2 to 7, the rim 18 is formed such that an inner peripheral surface 18*a* thereof has an inwardly overhanging shape to prevent flush water being swirlingly flowing as described later from jumping out of the rim 18.

The toilet main unit 2 is provided with a first spout port 22 and a second spout port 24 each for spouting flush water therefrom, wherein the first spout port 22 is provided at a position slightly rearward of a central region in a left (in front view) half of the inner peripheral surface of the rim 18 of the bowl portion 8, and the second spout port 24 is provided in a rear region in a right (in front view) half of the inner peripheral surface of the rim 18. Each of the first spout port 22 and the second spout port 24 is configured to allow flush water to swirlingly flow in the same direction (in FIG. 1, in a counterclockwise direction) to thereby form an aftermentioned swirl flow.

The common water flow passage 10 formed in the upper area of the rear half of the upper section of the toilet main unit 2 is branched into a first water flow passage 26 and a second water flow passage 28 each extending in a forward direction of the main unit 2. The first water flow passage 26 is designed to supply flush water to the first spout port 22, and the second water flow passage 28 is designed to supply flush water to the second spout port 24.

In the above flush toilet 1, the first spout port 22, the first water flow passage 26, the second spout port 24 and the second water flow passage 28 are integrally formed with the porcelain toilet main unit 2. However, the flush toilet according to this embodiment is not limited to this configuration, but the first spout port, the first water flow passage, the second spout port and the second water flow passage may be formed by providing a distributor or the like as a component separate from the toilet main unit.

In the flush toilet 1 according to this embodiment, as illustrated in FIGS. 2 to 7, the waste-receiving surface 16 of the bowl portion 8 is formed in an upwardly convex shape over the entire region thereof, along radial lines oriented toward an inlet of the drainage conduit 12.

Further, as illustrated in FIGS. 2 and 3, the bowl portion 8 has a water guide channel 30 formed in a region just below the inner peripheral surface 18*a* of the rim 8 to guide flush water. The water guide channel 30 is designed to allow flush water spouted from the first spout port 22 to swirlingly flow along the inner peripheral surface 18*a* of the rim 8, and formed to extend from the first spout port 22 toward a front end of the bowl portion 8 while gradually inclining downwardly (see FIG. 2), and then extend rearwardly from the front end while gradually inclining upwardly (see FIG. 3). Flush water spouted from the first spout port 22 is guided to swirlingly flow along the water guide channel 30, so that it becomes possible to form a large flow rate of major stream M which is directed to flow from a front end of the bowl portion 8 into an inlet 32*a* of an introduction conduit portion 32 of the drainage conduit 12, as described later.

Then, as illustrated in FIGS. 2 and 3, the drainage conduit 12 comprises an introduction conduit portion 32 connecting with an aftermentioned bottom of the recess 20 and extending rearwardly and obliquely downwardly, and a drainage trap conduit portion 34 connecting with the introduction conduit portion 32 and extending upwardly. The drainage trap conduit portion 34 is composed of a rising section (rising conduit portion) 34*a* and a lowering section (lowering conduit portion) 34*b*.

The introduction conduit portion 32 is formed as a smooth curved surface connecting with the aftermentioned bottom 36 of the recess 20, so that flush water flowing from the recess 20 into the introduction conduit portion 32 smoothly flows through the introduction conduit portion 32.

With reference to FIGS. 1 to 3, 9 and 10, the recess 20 of the bowl portion 8 and the drainage conduit 12 will be described in detail below.

Figure 9:
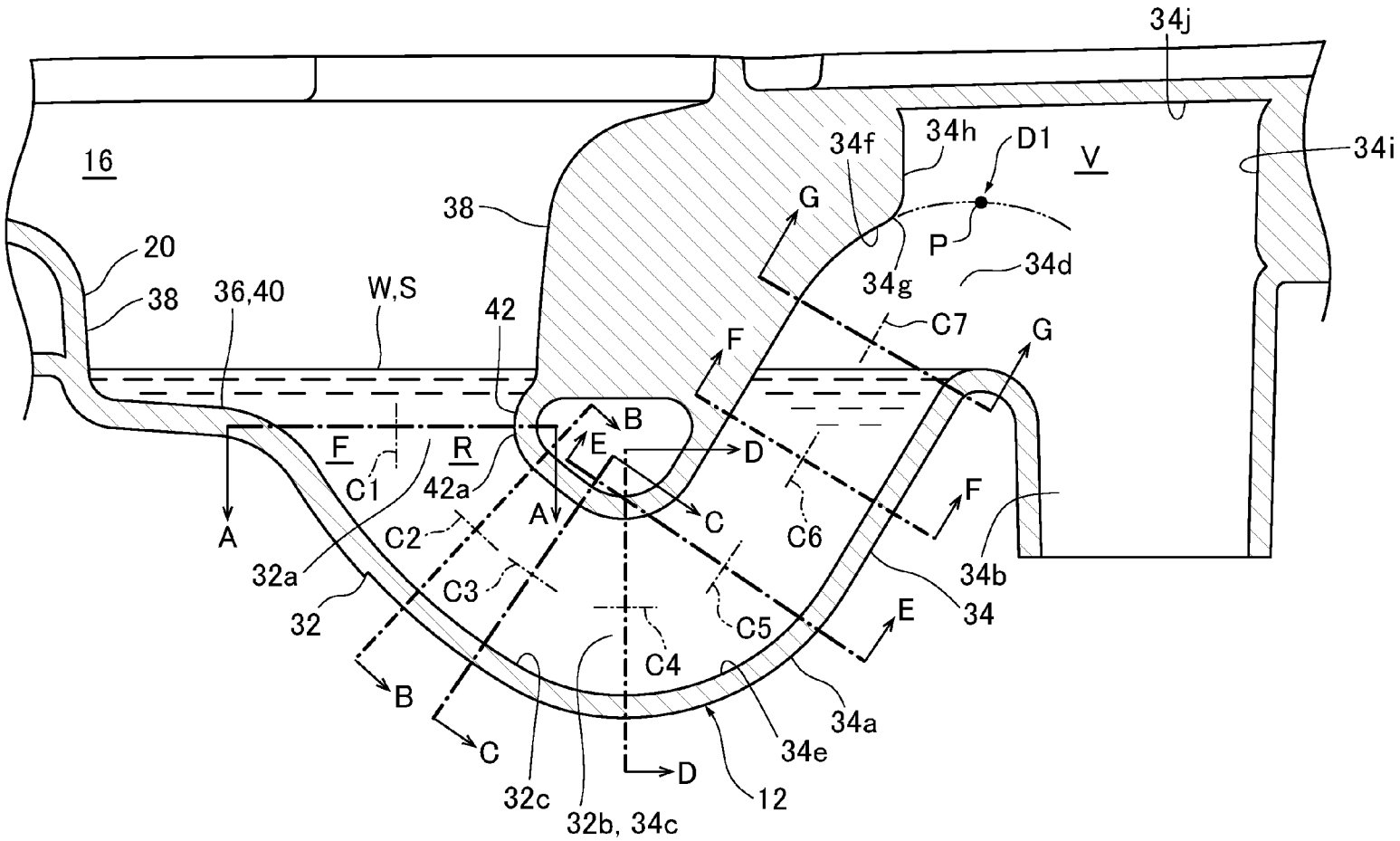
FIG. 9 is a fragmentary enlarged sectional view enlargedly illustrating a recess of a bowl portion and a drainage conduit in the flush toilet illustrated in FIG. 2.
Figure 10:
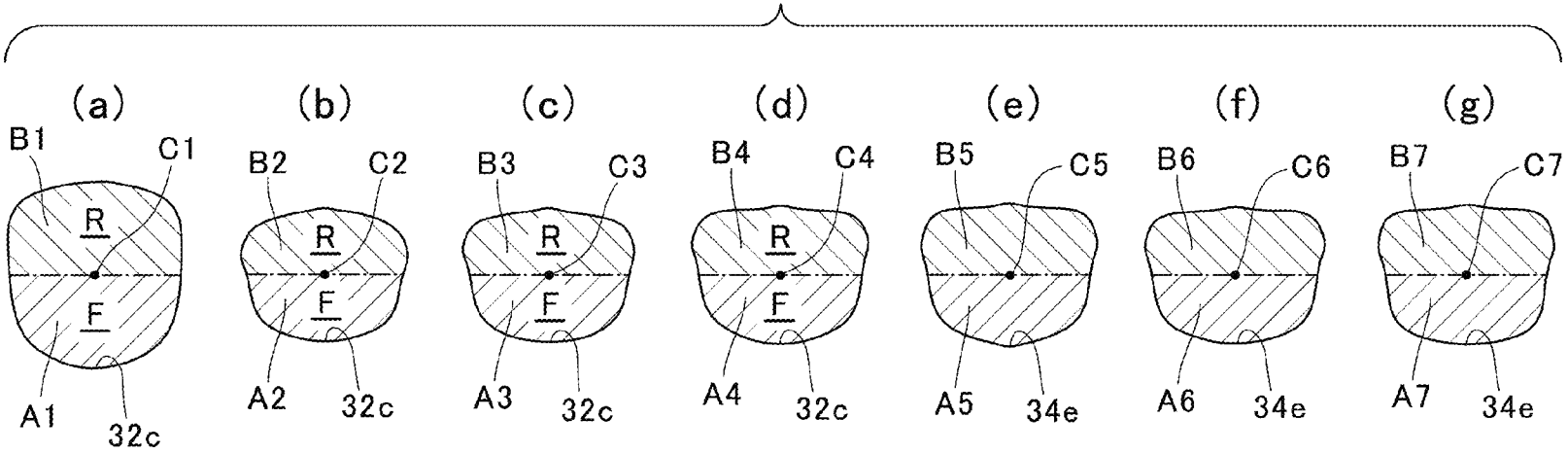
FIG. 10(*a*), FIG. 10(*b*), FIG. 10(*c*), FIG. 10(*d*), FIG. 10(*e*), FIG. 10(*f*) and FIG. 10(*g*) are, respectively, a sectional view taken along the line A-A in FIG. 9, a sectional view taken along the line B-B in FIG. 9, a sectional view taken along the line C-C in FIG. 9, a sectional view taken along the line D-D in FIG. 9, a sectional view taken along the line E-E in FIG. 9, a sectional view taken along the line F-F in FIG. 9 and a sectional view taken along the line G-G in FIG. 9.

FIG. 9 is a fragmentary enlarged sectional view enlargedly illustrating the recess of the bowl portion and the drainage duct in the flush toilet illustrated in FIG. 2. FIG. 10(*a*), FIG. 10(*b*), FIG. 10(*c*), FIG. 10(*d*), FIG. 10(*e*), FIG. 10(*f*) and FIG. 10(*g*) are, respectively, a sectional view taken along the line A-A in FIG. 9, a sectional view taken along the line B-B in FIG. 9, a sectional view taken along the line C-C in FIG. 9, a sectional view taken along the line D-D in FIG. 9, a sectional view taken along the line E-E in FIG. 9, a sectional view taken along the line F-F in FIG. 9 and a sectional view taken along the line G-G in FIG. 9.

As illustrated in FIGS. 1 to 3 and 9, the recess 20 has a bottom 36 located below a pooled water level W, and a wall surface 38 connecting between the bottom 36 and a lower edge of the waste-receiving surface 16. The bottom 36 has a front bottom surface 40 formed in a front region of the recess 20, and a rear bottom surface 42 formed in a rear region of the recess 20.

The front bottom surface 40 of the bottom 36 of the recess 20 is formed to extend horizontally. Alternatively, the front bottom surface 40 may be formed to gradually incline rearwardly and obliquely downwardly. As above, the front bottom surface 40 extends approximately horizontally. Preferably, a downward inclination angle is set in the range of 0 degree to 20 degrees.

Further, the front bottom surface 40 of the recess 20 is formed such that an entirety thereof is located below the pooled water level W, and above a lower end 42*a* of the rear bottom surface 42.

On the other hand, the rear bottom surface 42 of the bottom 36 of the recess 20 is formed to extend toward a front region of the introduction conduit portion 32, while inclining inwardly and obliquely downwardly. In this embodiment, a downward inclination angle of the rear bottom surface 42 with respect to a horizontal plane is set, preferably in the range of 0 degree to 60 degrees, more preferably in the range of 0 degree to 45 degrees.

The rear bottom surface 42 of the recess 20 is formed such that an entirety thereof is located below the pooled water level W. The rear bottom surface 42 of the recess 20 is not necessarily a flat surface, but may be formed as a curved surface which is slightly curved in an upwardly convex manner.

As illustrated in FIG. 1, right and left wall surface regions 38*b*, 38*a* of the wall surface 38 in right and left lateral regions of the recess 20 are formed to become flush with an inner lateral surface of the introduction conduit portion 32 of the drainage conduit 12, in an upward-downward direction. That is, the bottom 36 is not formed in right and left lateral regions of the recess 20. In addition, the inlet 32*a* of the introduction conduit portion 32 of the drainage conduit 12 is formed in a shape in which a maximum width Wmax thereof in a lateral (rightward-leftward) direction is greater than a maximum width Lmax thereof in a longitudinal (forward-rearward) direction, in top plan view. Further, the introduction conduit portion 32 of the drainage conduit 12 is also formed such that the inlet 32*a* thereof has a longitudinal center located rearward of a longitudinal center of a pooled water surface S, and an area equal to or less than one-half of an area of the pooled water surface S.

Each of the right and left wall surface regions 38*b*, 38*a* of the recess 20 may have slight irregularities, instead of a flat surface, as long as the right and left wall surface regions 38*b*, 38*a* of the recess 20 are formed to become capable of destroying a swirl flow of flush water which would otherwise be formed on the bottom 38.

As illustrated in FIG. 9 and FIGS. 10(*a*) to 10(*d*), on the assumption that, in each of the A-A cross-section, the B-B cross-section, the C-C cross-section and the D-D cross-section of the introduction conduit portion 32, a region located below a line extending horizontally while intersecting a central axis (C1, C2, C3, C4) thereof is a lower region, and a region located above the line is an upper region, the introduction conduit portion 32 is formed such that a cross-sectional area (A1, A2, A3, A4) of the lower region is less than a cross-sectional area (B1, B2, B3, B4) of the upper region, over the entire region ranging from the inlet 32*a* thereof connecting with the bottom 36 of the recess 20 to an outlet 32*b* thereof connecting with the rising section 34*a* of the drainage trap conduit portion 34.

That is, as compared to a rear region R of the inlet 32*a* of the introduction conduit portion 32 of the introduction conduit portion 32, into which flush water directly flows from the front end of the bowl portion 8, a cross-sectional area of a front region F of the inlet 32*a* of the introduction conduit portion 32 of the introduction conduit portion 32 located below the line extending horizontally while intersecting the central axis (C1, C2, C3, C4), in which, due to a relatively low flow velocity, small pieces of waste and floating pieces of waste are likely to stay, is set to a small value. Therefore, it becomes possible to reduce an internal region of the introduction conduit portion 32 having a relatively low flow velocity, thereby suppressing the occurrence of stagnation. In addition, the cross-sectional area of the front region F of the inlet 32*a* of the introduction conduit portion 32 or the lower region F of the introduction conduit portion 32, in which, due to a relatively low flow velocity, small pieces of waste and floating pieces of waste are likely to stay, is set to a small value, as mentioned above. Thus, in the rear region R of the inlet 32*a* of the introduction conduit portion 32 (the upper region R of the introduction conduit portion 32) into which flush water directly flows from the front end of the bowl portion 8, and the front region F of the introduction conduit portion 32 (the lower region F of the introduction conduit portion 32), the flow velocity distribution of flush water is uniformed (velocity distribution of flush water is equalized), and thereby a flow of flush water in the drainage conduit 12 becomes smooth, so that it becomes possible to reliably discharge small pieces of waste and floating pieces of waste, without staying of the waste in the front region F of the introduction conduit portion 32.

Further, as illustrated in FIG. 9 and FIGS. 10(*a*) to 10(*d*), the introduction conduit portion 32 is formed such that a bottom 32*c* thereof has a generally U shape, in each of the A-A cross-section, the B-B cross-section, the C-C cross-section and the D-D cross-section perpendicular to respective ones of the central axes C1, C2, C3, C4. Therefore, it becomes possible to move floating pieces of waste in the introduction conduit portion 32 to gather in an approximately central region of each of the A-A cross-section, the B-B cross-section, the C-C cross-section and the D-D cross-section of the introduction conduit portion 32 perpendicular to respective ones of the central axes C1, C2, C3, C4, and form a smooth flow in which a flow velocity distribution of flush water is uniformed in the introduction conduit portion 32. Therefore, it becomes possible to more reliably discharge small pieces of waste and floating pieces of waste without staying of the waste in the front region F (cross-sectionally outer region F) of the introduction conduit portion 32.

As illustrated in FIG. 9 and FIGS. 10(*e*) to 10(*g*), on the assumption that, in each of the E-E cross-section, the F-F cross-section and the G-G cross-section of the rising section 34*a* of the drainage trap conduit portion 34, a region located below a line extending horizontally while intersecting a central axis (C5, C6, C7) thereof perpendicular to each cross-section is a lower region, and a region located above the line is an upper region, the rising section 34*a* is formed such that a cross-sectional area (A5, A6, A7) of the lower region is less than a cross-sectional area (B5, B6, B7) of the upper region, over the entire region ranging from an inlet 34*c* thereof connecting with the outlet 32*b* of the introduction conduit portion 32, to a position around an outlet 34*d* thereof connecting to an inlet of the lowering section 34*b* of the drainage trap conduit portion 34, i.e., a position around a boundary point D1 between the rising section 34*a* and the lowering section 34*b*.

In addition, as illustrated in FIG. 9 and FIGS. 10(*e*) to 10(*g*), the rising section 34*a* is formed such that a bottom 34*e* thereof has a generally U shape, in each of the E-E cross-section, the F-F cross-section and the G-G cross-section perpendicular to respective ones of the central axes C5, C6, C7.

Further, as illustrated in FIG. 9 and FIGS. 10(*a*) to 10(*g*), the rising section of the drainage trap conduit portion 34 is formed such that a cross-sectional area thereof is greater than a cross-sectional area of the B-B cross-section, i.e., the smallest cross-sectional area, of the introduction conduit portion 32, over the entire region ranging from the inlet 34*c* to the outlet 34*d*. That is, each of a cross-sectional area (A5+B5) of the E-E cross-section, a cross-sectional area (A6+B6) of the F-F cross-section, and a cross-sectional area (A7+B7) of the G-G cross-section of the rising section 34*a* is set to be greater than the cross-sectional area of the B-B cross-section, i.e., the smallest cross-sectional area, of the introduction conduit portion 32. Therefore, it becomes possible to allow flush water passing through the introduction conduit portion 32 to be smoothly discharged along the rising section 34*a*.

As illustrated in FIG. 9, when the boundary point D1 between the rising section 34*a* and the lowering section 34*b* of the drainage trap conduit portion 34 is assumed to be a virtual top P of an internal upper surface 34*f* of the rising section 34*a*, the upper surface 34*f* of the rising section 34*a* extends to a rear end 34*g* thereof located forward of a position around the top P, and a wall surface 34*h* is formed to extend upwardly from the rear end 34*g* of the upper surface 34*f* of the rising section 34*a*. Further, a wall surface 34*i* is formed at a position rearward of and in opposed relation to the wall surface 34*h* to extend upwardly from an internally rear wall surface of the lowering section 34*b*, and a ceiling surface 34*i* is formed to connect between respective upper ends of the wall surfaces 34*h*, 34*i*. The wall surfaces 34*h*, 34*i* and the ceiling surface 34*i* define a siphon-action occurrence preventing space V for preventing the occurrence of a siphon action. The siphon-action occurrence preventing space V allows flush water flowing into the rising section 34*a* to reliably move upwardly and reach the rear end 34*g* of the upper surface 34*f* of the rising section 34*a*, without flowing back forwardly. Then, the siphon-action occurrence allows flush water passing through the rear end 34*g* of the upper surface 34*f* of the rising section 34*a*, to be reliably discharged to the lowering section 34*b*, after passing through the position around the top P, without the occurrence of a siphon action.

Figure 11:
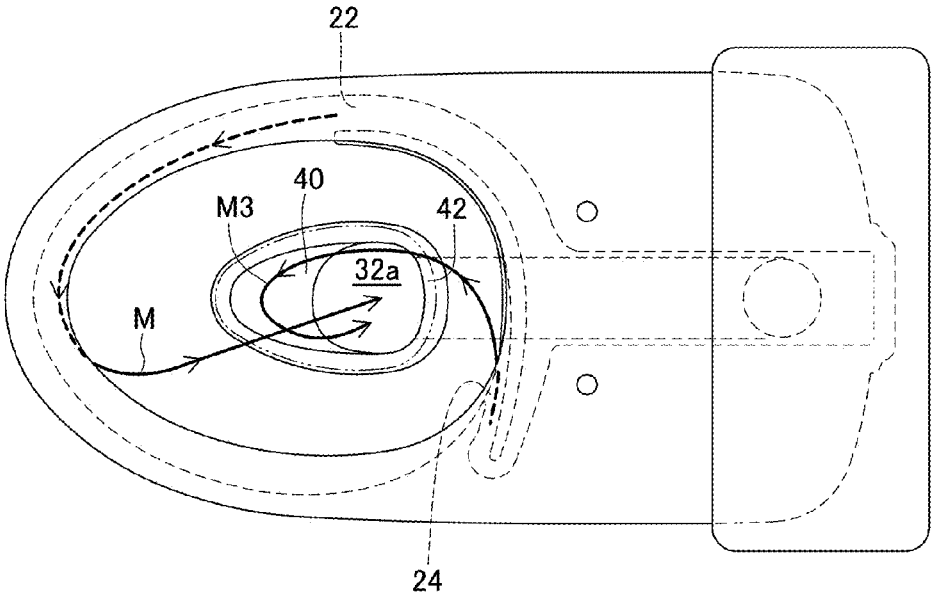
FIG. 11 is a top plan view illustrating a state of a flow of flush water in the flush toilet according to the embodiment of the present invention.
Figure 12:
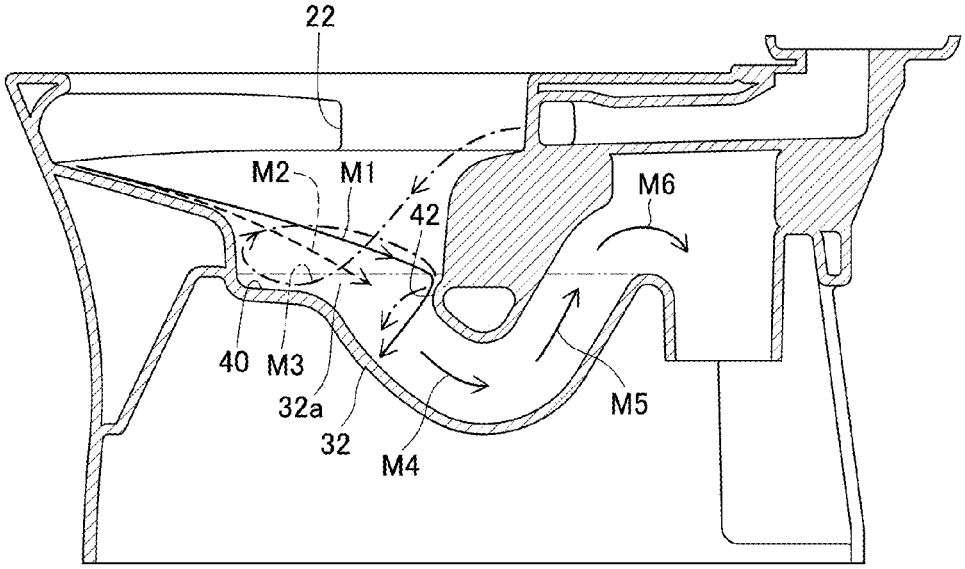
FIG. 12 is a sectional view of the flush toilet in FIG. 11.
Figure 13:
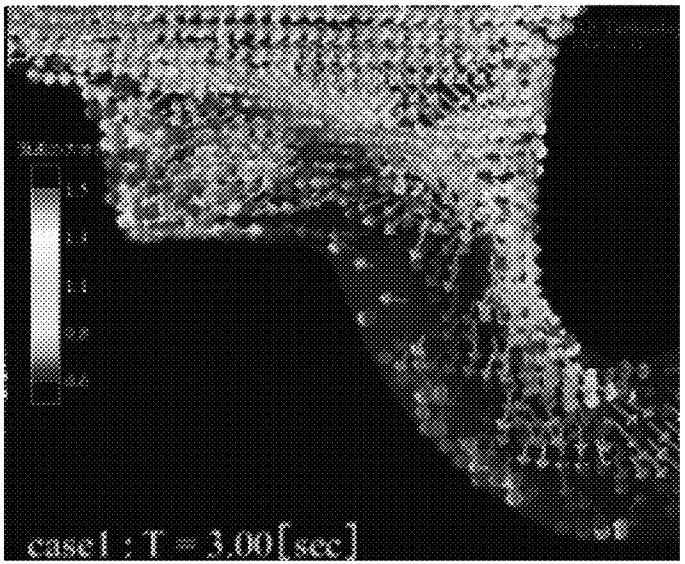
FIG. 13(*a*) and FIG. 13(*b*) are, respectively, an analysis result representing a flow velocity of flush water in a flush toilet as a comparative example and an analysis result representing a flow velocity of flush water in the flush toilet according to the embodiment of the present invention.
Figure 13:
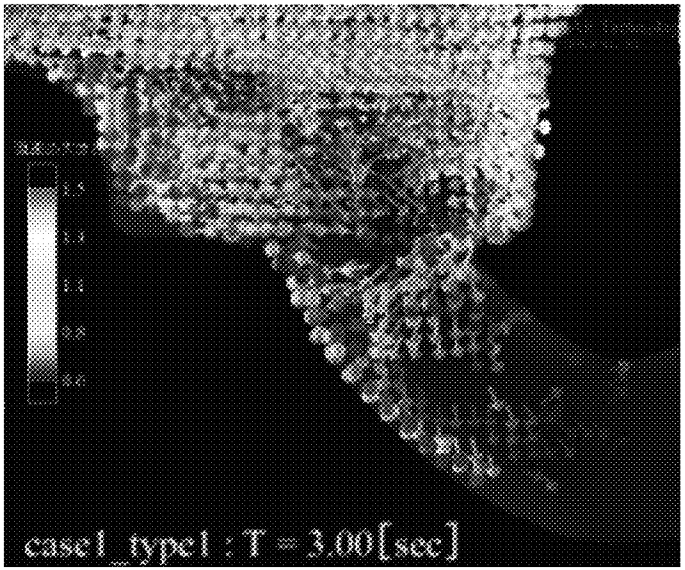

With reference to FIGS. 11 to 13, a flushing operation of the flush toilet according to this embodiment will be described below. FIG. 11 is a top plan view illustrating a state of a flow of flush water in the flush toilet according to this embodiment, and FIG. 12 is a sectional view of the flush toilet in FIG. 11. FIG. 13(*a*) and FIG. 13(*b*) are, respectively, an analysis result representing a flow velocity of flush water in a flush toilet as a comparative example with respect to the present invention and an analysis result representing a flow velocity of flush water in the flush toilet according to this embodiment.

First of all, when a user operates the manual operation lever of the reservoir tank 4, the discharge valve 14 is opened, so that flush water in the reservoir tank 4 is supplied to the common water flow passage 10, and spouted from the first spout port 22 and the second spout port 24 via the first water flow passage 26 and the second water flow passage 28 branched from the common water flow passage 10.

Flush water spouted from the first spout port 22 is guided to flow forwardly along the water guide channel 30 formed just below the inner peripheral surface 18*a* of the rim 18 of the bowl portion 8, and then, after passing through the front end of the bowl portion 8, flow rearwardly. In this process, a part of flush water falls down along the bowl portion 8 while swirlingly flowing, thereby cleaning the waste-receiving surface 16.

A substantial portion of flush water spouted from the first spout port 22 and guided to flow along the water guide channel 30 forms a large flow rate of major stream M which is directed to flow from the front end of the bowl portion 8 into the inlet 32*a* of the introduction conduit portion 32 of the drainage conduit 12 (see FIG. 11). A part Ml of the major stream M collides with the rear bottom surface 42 of the bottom 36 of the recess 20, and then flows out forward and obliquely downwardly toward the front region inside the introduction conduit portion 32 (see FIG. 12). On the other hand, a remaining part M2 of the major stream M directly flows into the inlet 32*a* of the introduction conduit portion 32 (see FIG. 12).

In this regard, in the above embodiment, the bowl portion 8 is formed with the water guide channel 30 for allowing flush water to swirlingly flow along the inner peripheral surface of the rim 18, wherein the water guide channel 30 is formed to extend from the first spout port 22 toward the front end of the bowl portion 8 while gradually inclining downwardly and then extend rearwardly from the front end while gradually inclining upwardly, so that it becomes possible to form a large flow rate of major stream M.

Further, in the above embodiment, the waste-receiving surface 16 of the bowl portion 8 is formed in an upwardly convex shape over the entire region thereof, so that flush water flowing on the waste-receiving surface 16 can be smoothly guided to gather at the inlet 42*a* of the introduction conduit portion 32, and therefore a flow of flush water in the introduction conduit portion 32 becomes smooth.

Then, after flush water spouted forwardly from the first spout port 22 forms a major stream M which is directed to flow from the front end of the bowl portion 9 toward the inlet 32*a* of the introduction conduit portion 32, as mentioned above, a part M1 of the major stream is brought into collision with the rear bottom surface 42 of the bottom 36 of the recess 20, and the collided major stream Ml is guided to flow toward the front region inside the introduction conduit portion 32. Particularly, the rear bottom surface 42 of the bottom 36 is formed to incline inwardly and obliquely downwardly, so that it becomes possible to smoothly guide the partial major stream M1 after colliding with the rear bottom surface, toward the front region of the introduction conduit portion 32. Concurrently, a remaining part M2 of the major stream flows into the rear region of the introduction conduit portion 32.

Therefore, in the rear region R (lower region R) of the introduction conduit portion 32 (the upper region R of the introduction conduit portion 32) into which flush water directly flows from the front end of the bowl portion 8, and the front region F (upper region F) of the introduction conduit portion 32 into which flush water flows after colliding with the rear bottom surface 42 of the bottom surface 36, the flow velocity distribution of flush water is uniformed (velocity distribution of flush water is equalized), i.e., no stagnation occurs in the front region of the introduction conduit portion 32, and thereby a flow of flush water in the introduction conduit portion 32 becomes smooth, so that it becomes possible to reliably discharge small pieces of waste and floating pieces of waste, without staying of the waste in the front region of the introduction conduit portion 32.

In addition, the introduction conduit portion 32 of the drainage duct 12 is formed such that it connects with the bottom of the recess, with an inner diameter (cross-sectional shape) approximately equal to that of the bottom, and extends rearwardly and obliquely downwardly, so that it becomes possible to smoothly introduce flush water into the introduction conduit portion 32, and therefore reliably discharge small pieces of waste and floating pieces of waste.

On the other hand, flush water spouted from the second spout port 24 falls down along the bowl portion 8 while swirlingly flowing, thereby cleaning a rear region of the waste-receiving surface 16. Then, the flush water spouted from the second spout port 24 forms a stream M3 flowing into the recess 20 from a position rearward of the recess 20 (see FIG. 12). The stream M3 of flush water from the second spout port 24 flows toward the front bottom surface 40 of the bottom 36 of the recess 20.

In this regard, the front bottom surface 40 of the recess 20 is formed to extend approximately horizontally, so that the stream M3 of flush water spouted from the second spout port 24 collides with the front bottom surface 40, and the collided flush water is moved upwardly, and mixed with the major streams M1, M2 flowing thereabove. Therefore, waste is effectively agitated and smoothly introduced into the introduction conduit portion 32.

In addition, the front bottom surface 40 of the recess 20 is formed to be located above the lower end 42*a* of the rear bottom surface 42, so that the stream M3 of flush water spouted from the second spout port 24 and moved upwardly due to the collision with the front bottom surface 40 flows rearwardly, and collides with the rear bottom surface 42, so that it is guided to the front region of the introduction conduit portion 32.

Further, the recess 20 is formed such that each of the wall surfaces 38*a*, 38*b* in the right and left lateral regions thereof becomes flush with the internal lateral surface of the introduction conduit portion 32, in an upward-downward direction, i.e., the bottom 36 is not formed in the right and left lateral regions of the recess 20. Therefore, it becomes possible to destroy a swirl flow of flush water which would otherwise be formed on the bottom 36, by the right and left wall surface regions of the recess 20, and effectively guide flush water to the front region of the introduction conduit portion 32, thereby effectively uniform a velocity distribution in the front and rear regions of the introduction conduit portion 32.

Further, the inlet 32*a* of the drainage conduit 32 is formed in the shape in which the maximum width Wmax thereof in the lateral direction is greater than the maximum width Lmax thereof in the longitudinal direction, in top plan view, so that the relatively small longitudinal width of the inlet makes it possible to more easily guide flush water toward the front region of the introduction conduit portion 32, and the relatively large lateral width of the inlet makes it possible to guide larger waste to the introduction conduit portion 32.

Further, the introduction conduit portion 32 is formed such that the longitudinal center of the inlet 32*a* is located rearward of the longitudinal center of the pooled water surface, so that it becomes possible to more easily guide flush water to the front region of the introduction conduit portion 32. The introduction conduit portion 32 is also formed such that the area of the inlet 32*a* is equal to or less than one-half of the area of the pooled water surface S, so that flush water spouted from the second spout port 24 and introduced from a position rearward of the recess collides with the bottom 36, and the collided flush water flows rearwardly and, after colliding with the rear bottom surface 42, flows into the front surface of the introduction conduit portion 32. Thus, a flow of flush water in the drainage duct becomes smoother.

Further, on the assumption that a region located below a line extending horizontally while intersecting the central axis (C1, C2, C3, C4) of the introduction conduit portion 32 is a lower region, and a region located above the line is an upper region, the introduction conduit portion 32 is formed such that the cross-sectional area (A1, A2, A3, A4) of the lower region is less than the cross-sectional area (B1, B2, B3, B4) of the upper region, over the entire region ranging from the inlet 32*a* thereof connecting with the bottom 36 of the recess 20 to the outlet 32*b* thereof connecting with the rising section 34*a*. Thus, in the rear region R of the introduction conduit portion 32 (the upper region R of the introduction conduit portion 32) into which flush water directly flows from the front end of the bowl portion 8, and the front region F of the introduction conduit portion 32 (the upper region of the introduction conduit portion 32), the flow velocity distribution of flush water is uniformed, so that flush water smoothly flows through the introduction conduit portion 32.

Further, the introduction conduit portion 32 is formed such that the bottom 32*c* thereof has a generally U shape, so that it becomes possible to move floating pieces of waste in the introduction conduit portion 32 to gather in an approximately central region of each of the A-A cross-section, the B-B cross-section, the C-C cross-section and the D-D cross-section of the introduction conduit portion 32 perpendicular to respective ones of the central axes C1, C2, C3, C4, and form a smooth flow (stream) M4 toward the rising section 34*a*. This allows small pieces of waste and floating pieces of waste to be discharged to the rising section 34*a* without staying of the waste in the front region F of the introduction conduit portion 32 (the lower region F of the introduction conduit portion 32).

Further, the rising section 34*a* is formed such that a cross-sectional area thereof is greater than the smallest cross-sectional area (A2+B2) of the introduction conduit portion 32, so that flush water containing small pieces of waste and floating pieces of waste and flowing into the rising section 34*a* forms a flow (stream) M5 smoothly flowing upwardly through the rising section 34*a* toward the lowering section 34*b*. Therefore, flush water passing through the introduction conduit portion 32 is smoothly discharged along the rising section 34*a*. Thus, it becomes possible to reliably discharge small pieces of waste and floating pieces of waste, without staying of the waste in the lower region of the drainage conduit 12.

Then, flush water flowing from the introduction conduit portion 32 into the rising section 34*a* and moving upwardly along the rising section 34*a* forms a flow (stream) M6 toward the lowering section 34*b*, after passing through a position around the top P as the boundary point D1 between the rising section 34*a* and the lowering section 34*b*. In this process, the occurrence of a siphon action is suppressed by the siphon-action occurrence preventing space V defined in a region above a position around the top P. Therefore, the flow M5 moving upwardly along the rising section 34*a* can reliably reach to the rear end 34*g* of the upper surface 34*f* of the rising section 34*a*, without flowing back forwardly, and, when flush water passes through the rear end 34*g* of the upper surface 34*f* of the rising section 34*a*, it forms a flow (stream) M6 which is capable of being reliably discharged to the lowering section 34*b*, after passing through the position around the top P. As a result, small pieces of waste and floating pieces of waste are reliably discharged without staying in the front (lower) region F of the introduction conduit portion 32.

The inventors of this application checked a flow of flush water in the flush toilet according to the above embodiment of the present invention by experimental testing and by numerical analysis. For the experimental testing and numerical analysis, a flush toilet devoid of the rear bottom surface of the bottom of the recess was prepared as a comparative example.

As illustrated in FIG. 13(*a*), in the flush toilet as the comparative example, stagnation occurs in the front region of the introduction conduit portion. On the other hand, as illustrated in FIG. 13(*b*), in the flush toilet according to the above embodiment of the present invention, the velocity distribution is uniformed in the front and rear regions of the introduction conduit portion, without the occurrence of stagnation in the front region of the introduction conduit portion.

As described above, in the flush toilet according to the above embodiment, the flow velocity distribution of flush water is uniformed (velocity distribution is equalized) in the front and rear regions of the introduction conduit portion 32, without the occurrence of stagnation in the front region of the introduction conduit portion 32, and therefore the flow of flush water in the introduction conduit portion 32 becomes smooth, so that it becomes possible to reliably discharge small pieces of waste and floating pieces of waste, without staying of the waste in the front region of the introduction conduit portion 32.

Although the above embodiment has been described based on a wash-down type flush toilet, the present invention may be applied to a siphon-type flush toilet.

Further, although the above embodiment is configured such that flush water is spouted from the first spout port 22 and the second spout port 24, the present invention is not limited thereto, but a configuration may be employed in which flush water is spouted from only the first spout port, while omitting the second spout port. In this case, an amount of flush water to be spouted from the first spout port can be increased to allow a part of flush water spouted from the first spout port to be guided to a rear end of the bowl portion, while swirlingly flowing, and introduced into the recess from a position rearward of the recess, i.e., it is possible to obtain substantially the same function as that of flush water to be spouted from the second spout port.

What is claimed is:

1. A flush toilet for flushing a toilet main unit with flush water supplied from a flush water source, to discharge waste, comprising:

a bowl portion having a waste-receiving surface, a rim located along an upper edge thereof, and a recess formed below the waste-receiving surface;

a water spouting portion for spouting the flush water toward a front end of the bowl portion so as to form a swirl flow which swirlingly flows along an inner peripheral surface of the rim; and a drainage conduit having an inlet connecting with the recess of the bowl portion so as to discharge waste therethrough, wherein the recess of the bowl portion has a bottom located below a pooled water level, and a wall surface connecting between the bottom and a lower edge of the waste-receiving surface, the bottom of the recess having a front bottom surface formed in a front region of the recess, and a rear bottom surface formed in a rear region of the recess, and wherein:

the bowl portion is configured to allow flush water spouted from the water spouting portion to form a major stream which is directed to flow from the front end of the bowl portion toward the inlet of the drainage conduit; and the rear bottom surface of the bottom of the recess is configured to allow a part of the major stream to collide therewith, and then guide the collided major stream to a front region inside the drainage conduit.

2. The flush toilet according to claim 1, wherein the drainage conduit comprises: an introduction conduit portion connecting with the bottom of the recess, with an inner diameter approximately equal to that of the bottom, and extending rearwardly and obliquely downwardly; and a drainage trap conduit portion connecting with the introduction conduit portion and extending upwardly.

3. The flush toilet according to claim 1, wherein the rear bottom surface of the recess is formed to incline inwardly and obliquely downwardly.

4. The flush toilet according to claim 3, wherein the front bottom surface of the recess is formed to extend approximately horizontally.

5. The flush toilet according to claim 4, wherein the front bottom surface of the recess is formed to be located above a lower end of the rear bottom surface.

6. The flush toilet according to claim 3, wherein the recess is formed such that a wall surface in each of right and left lateral regions thereof becomes flush with an internal lateral surface of the drainage conduit, in an upward-downward direction.

7. The flush toilet according to claim 1, wherein the inlet of the drainage conduit is formed in a shape in which a maximum width thereof in a lateral direction is greater than a maximum width thereof in a longitudinal direction, in top plan view.

8. The flush toilet according to claim 6, wherein the drainage conduit is formed such that, in top plan view, the inlet thereof has a longitudinal center located rearward of a longitudinal center of a pooled water surface, and an area equal to or less than one-half of an area of the pooled water surface.

9. The flush toilet according to claim 1, wherein the waste-receiving surface of the bowl portion is formed in an upwardly convex shape over an entire region thereof.

10. The flush toilet according to claim 1, wherein the bowl portion is formed with a water guide channel for allowing flush water spouted from the water spouting portion to swirlingly flow along the inner peripheral surface of the rim, the water guide channel being formed to extend from the water spouting portion toward the front end of the bowl portion while gradually inclining downwardly and then extend rearwardly from the front end while gradually inclining upwardly.

11. The flush toilet according to claim 1, wherein the drainage conduit comprises: an introduction conduit portion connecting with the bottom of the recess and extending rearwardly and obliquely downwardly; a rising conduit portion connecting with the introduction conduit portion and extending upwardly; and a lowering conduit portion connecting with the rising conduit portion and extending downwardly, wherein, on an assumption that, in a cross-section of the introduction conduit portion perpendicular to a central axis thereof, a region located below a line extending horizontally while intersecting the central axis is a lower region, and a region located above the line is an upper region, the introduction conduit portion is formed such that a cross-sectional area of the lower region is less than a cross-sectional area of the upper region, over an entire region ranging from an inlet thereof connecting with the bottom of the recess to an outlet thereof connecting with the rising conduit portion.

12. The flush toilet according to claim 11, wherein the introduction conduit portion is formed such that a bottom of the cross-section thereof perpendicular to the central axis has a generally U shape.

13. The flush toilet according to claim 11, wherein the rising conduit portion of the drainage conduit is formed such that a cross-sectional area thereof is greater than a smallest cross-sectional area of the introduction conduit portion.

14. The flush toilet according to claim 13, wherein the drainage duct is formed such that, when a boundary point between the rising conduit portion and the lowering conduit portion is assumed to be a top of an internal upper surface of the rising conduit portion, a space for preventing occurrence of a siphon action is defined in a region above a position around the top.

* * * * *